US005642582A

United States Patent [19]

Grams

[11] Patent Number: 5,642,582

[45] Date of Patent: Jul. 1, 1997

[54] BASE PAD FOR HAND GUN MAGAZINE

[76] Inventor: Beven Grams, 2435 Norse Ave., Costa Mesa, Calif. 92627

[21] Appl. No.: 627,052

[22] Filed: Apr. 3, 1996

[51] Int. Cl.[6] ..... F41A 9/65

[52] U.S. Cl. ..... 42/50

[58] Field of Search ..... 42/50, 49.01, 18, 42/22, 7; 89/34

[56] References Cited

U.S. PATENT DOCUMENTS

| | | | |
|---|---|---|---|
| 951,657 | 3/1910 | Pedersen | 42/49.01 |
| 1,015,490 | 1/1912 | Harrington | 42/7 |
| 1,184,078 | 5/1916 | Cooke | 42/7 |
| 3,399,481 | 9/1968 | Giorgini | 42/49.01 |
| 4,139,959 | 2/1979 | Howard et al. | 42/50 |
| 4,310,982 | 1/1982 | Kast et al. | 42/49.01 |
| 4,495,720 | 1/1985 | Bross | 42/7 |
| 4,514,922 | 5/1985 | Farrar et al. | 42/7 |
| 4,765,081 | 8/1988 | Dieringer | 42/50 |
| 4,862,619 | 9/1989 | Baldus et al. | 42/7 |
| 5,081,778 | 1/1992 | Switzer | 42/50 |
| 5,206,444 | 4/1993 | Oliver | 42/7 |
| 5,329,718 | 7/1994 | Howard | 42/50 |
| 5,438,783 | 8/1995 | Sniezak et al. | 42/7 |

FOREIGN PATENT DOCUMENTS

| | | | |
|---|---|---|---|
| 3422334 | 12/1985 | Germany | 42/50 |

*Primary Examiner*—Stephen M. Johnson

*Attorney, Agent, or Firm*—Price, Gess & Ubell

[57] ABSTRACT

In a 1911-type hand gun used for target or staged shooting, a magazine utilizing a standard base pad limits the number of rounds that can be carried by that magazine. A base pad designed for exceptionally secure fastening and easy removal from the magazine also permits multiple extra rounds to be carried by the magazine, while still being within competition required size specifications.

19 Claims, 3 Drawing Sheets

BASE PAD FOR HAND GUN MAGAZINE

BACKGROUND OF THE INVENTION

1. Field of the Invention

The present invention relates generally to improvements in magazines for hand guns and, more particularly, pertains to new and improved base pads which attached to the open bottom of a magazine tube.

2. Description of Related Art

One of the most critical problems confronting the designers of sports hand guns used for target and staged shooting competition is the design of a magazine that carries a maximum number of bullets within the size and specification for the hand gun. Since all shooting competitions are timed, the changing of an empty magazine during the competition is wasted time. The bulk of competition hand guns are built on the Colt 1911 frame, which is the standard side arm issued in World War II by the U.S. Military. The hand guns built on these frames may be made in a variety of calibers such as 9 mm, 10 mm, 45 and 38 calibers.

The 1911 guns all utilize multibullet magazine tubes which have an open bottom and a shaped top through which the rounds are individually fed into the chamber of the gun. The follower is spring-mounted and moves the rounds up from the bottom of the magazine through the shaped opening in the top of the magazine into the chamber of the gun. The follower is usually made out of a hard synthetic material such as Delron. The bottom of the magazine tube is closed off by a removable base pad which may also be made of Delron. Because the 1911 Colt frame has a standard size, the magazine tubes that fit within that frame must also be a standard size, thereby limiting the round holding capacity of the magazine.

Aftermarket conversion kits for magazines abound. These are only capable of adding one round to the holding capacity of the magazine and still remain within the dimensional requirements set out in the rules for USPSA or IPSC competition.

OBJECTS AND SUMMARY OF THE INVENTION

It is an object of this invention to provide a base pad that conforms with the dimensional requirements of competitive shooting and adds multiple round capacity to the magazine.

It is a further object of this invention to provide a base pad that securely fastens to the bottom of the magazine tube and is easily removed and installed.

These objects and the general purpose of this invention are accomplished by providing a base pad that receives and encircles the bottom of a magazine tube with the bottom resting on a ledge that runs around the inside of the pad. The magazine tube has a lip on two opposing outside edges on its bottom. The base pad fastens to the magazine tube by a pin that slides through an open shaft along the sides of the pad to hold the magazine tube to the internal ledge of the pad by the lips. When the pin is fully inserted into the shaft, its head rides over a ridge which locks the pin to the base pad outside wall. Once locked in, the pin can only be removed by forcibly disengaging the head with a screwdriver or similar tool to force it back over the locking ridge.

BRIEF DESCRIPTION OF THE DRAWINGS

The present invention, both as to its organization and manner of operation, together with other objects and advantages, may best be understood by reference to the following detailed description, taken in connection with the accompanying drawings, in which like reference numerals designate like parts throughout the figures, and wherein.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide a base pad for a magazine which complies with the dimensional requirements of competition shooting and adds at least two rounds to the capacity of the magazine, while securely fastening to the bottom of the magazine tube and permitting easy attachment and removal.

Figure 1:
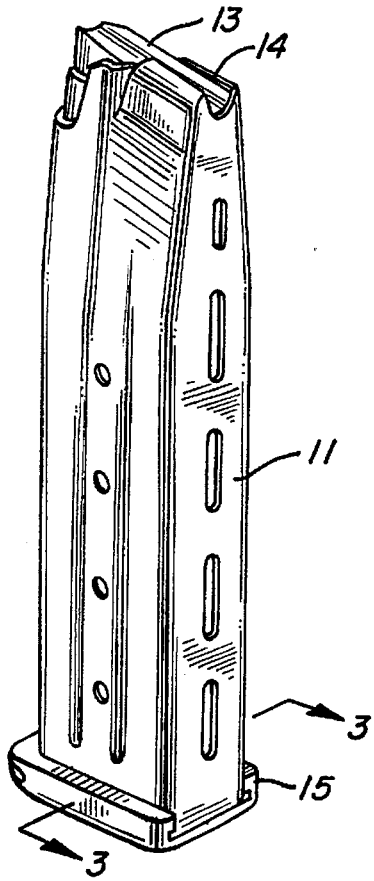
FIG. 1 PRIOR ART
FIG. 1 is a perspective of a prior art magazine having a prior art base pad attached to the magazine tube.
Figure 3:
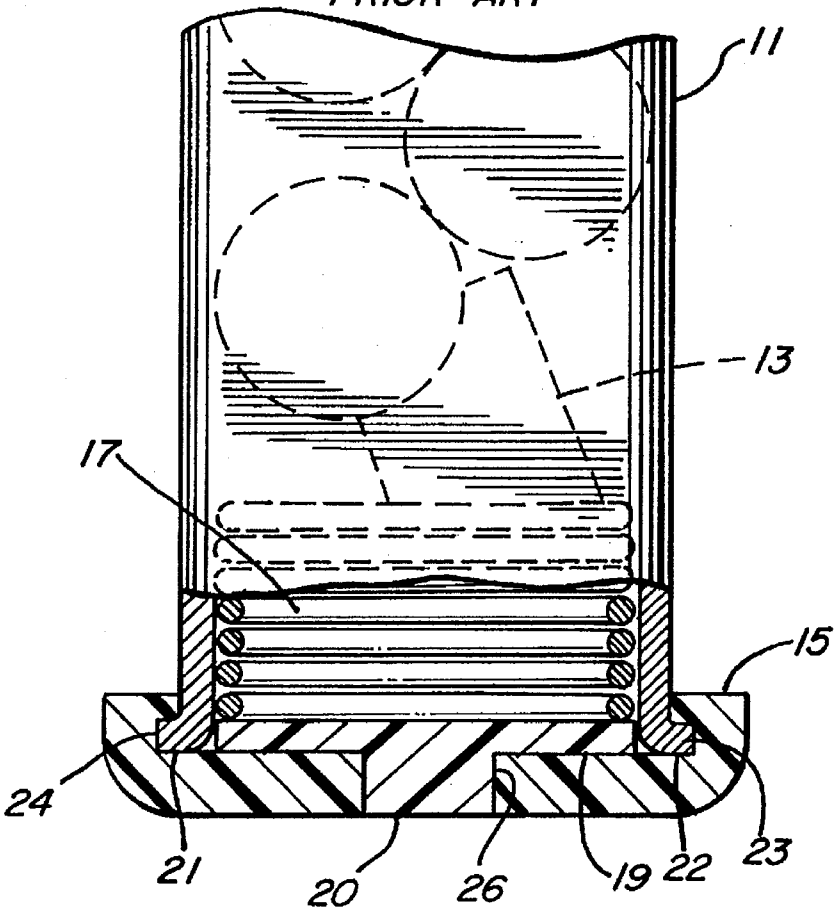
FIG. 3 PRIOR ART
FIG. 3 is a cross-section of the prior art base pad of FIG. 1, taken along sectional line 3—3.

FIGS. 1 and 3 illustrate a typical magazine having a magazine tube and base pad construction used today. The magazine tube 11 can hold multiple rounds, depending upon the size of the round. It contains a follower 13 which pushes each round through a formed opening 14 at the top by the action of a spring 17 (FIG. 3).

The prior art base pad 15, as can be more clearly seen in FIG. 3, attaches to the bottom of magazine tube 11 by a slide-and-groove, 21, 22. A pair of lips 23, 24 are located at the bottom of magazine tube 11 along opposite sides thereof. These lips slide snugly within a pair of grooves 21, 22 located in the base pad 15. A base plate platform 19 is located on the inside of the base pad 15. The platform 19 has a boss 20 extending from its bottom through an aperture 26 in the base pad 15.

To remove base pad 15, base plate 19 must be pushed into the magazine tube by pushing on the boss 20 far enough so that the lips 23, 24 of the magazine can freely slide in the slots 21, 22 of the base plate. Pushing the base plate 19 inward is against the considerable force of the spring 17. If one is not careful to hold the base plate 19 during removal of base pad 15, the spring and base plate 19 tend to fly out of the magazine 11. This is a difficult task at best.

The base pad 25 of the present invention, besides having a more secure attachment mechanism for attaching to the base of magazine tube 11, also provides additional room in the magazine, permitting at least two more rounds to be carried. Base pad 25 is preferably machined from a solid piece of Delron or similar high strength but light material.

Figure 2:
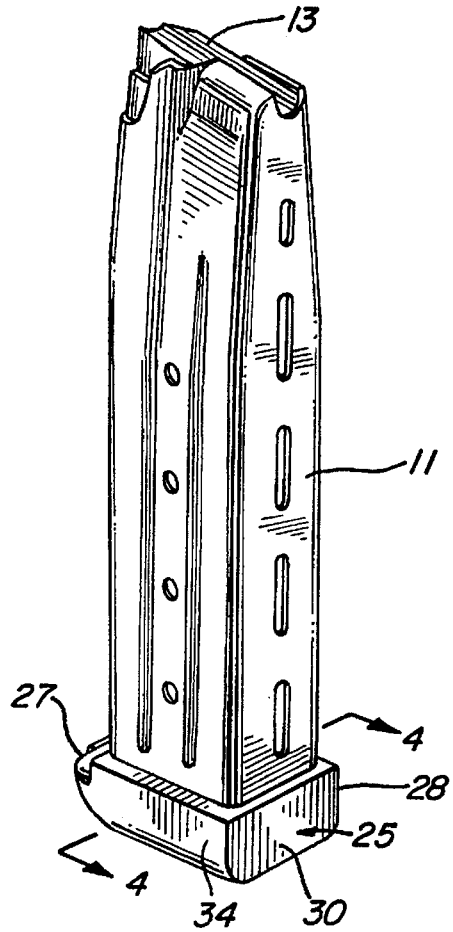
FIG. 2 is a perspective of a magazine with the base pad of the present invention.
Figure 4:
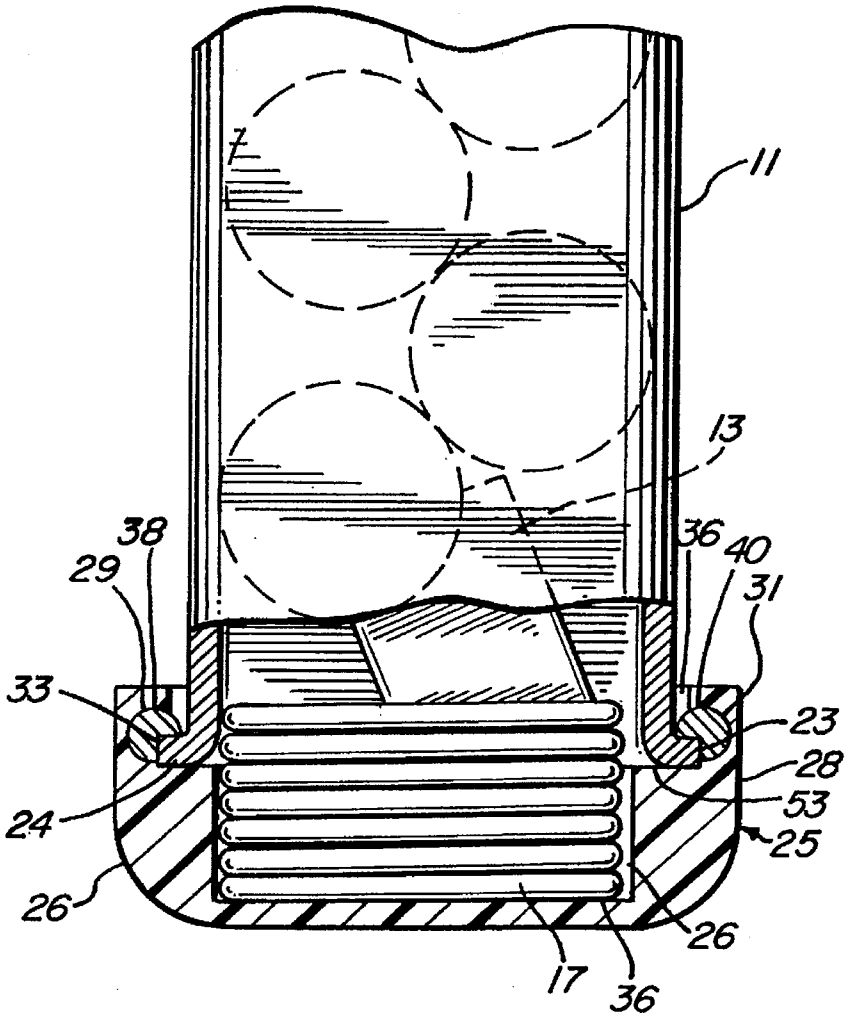
FIG. 4 is a cross-section of the base pad of FIG. 2, taken along sectional line 4—4.

Referring first to FIGS. 2 and 4, the base pad 25 of the present invention is essentially a five-sided container having two opposite sides 34, 28 and two opposite ends 30, 32. The base pad 25 has a defined external shape and an internal cavity which conforms to the external shape of the magazine at its open bottom. The bottom of the magazine tube 11, as shown in FIG. 4, freely fits into the open top 36 of base pad 25. There are no grooves for the lips 23, 24 at the bottom edges of magazine tube 11 to slide into. The base of magazine tube 11 simply fits into the open top 36 of base pad 25. The bottom edge of magazine tube 11, which is defined along the sides of magazine tube 11 by lips 23, 24, rests on an inside ledge 53, which is located some distance above the bottom 36 of the base pad 25. A cavity 26 is created between the ledge and the bottom 36 of the base pad 25. The overall dimension of the base pad and magazine tube when installed in the hand gun, however, is still within the dimensional specifications required by the rules used by recognized competitions. This additional space 26 is sufficient to allow at least two, and perhaps three additional rounds to be safely carried by the magazine.

Figure 7:
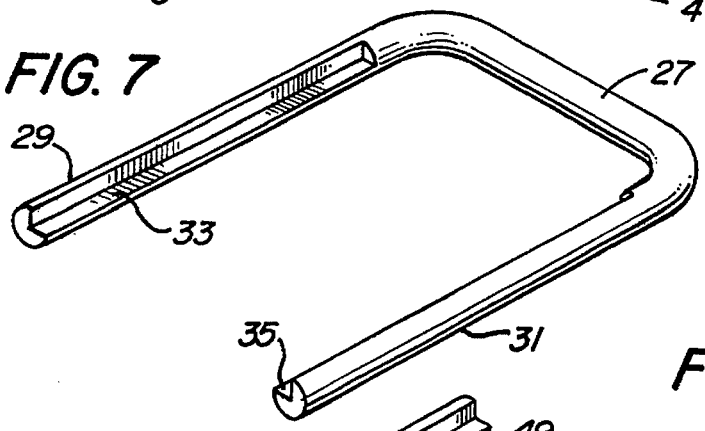
FIG. 7 is a perspective of a preferred form of the clip used to hold the base pad of the present invention to a magazine tube.
Figure 5:
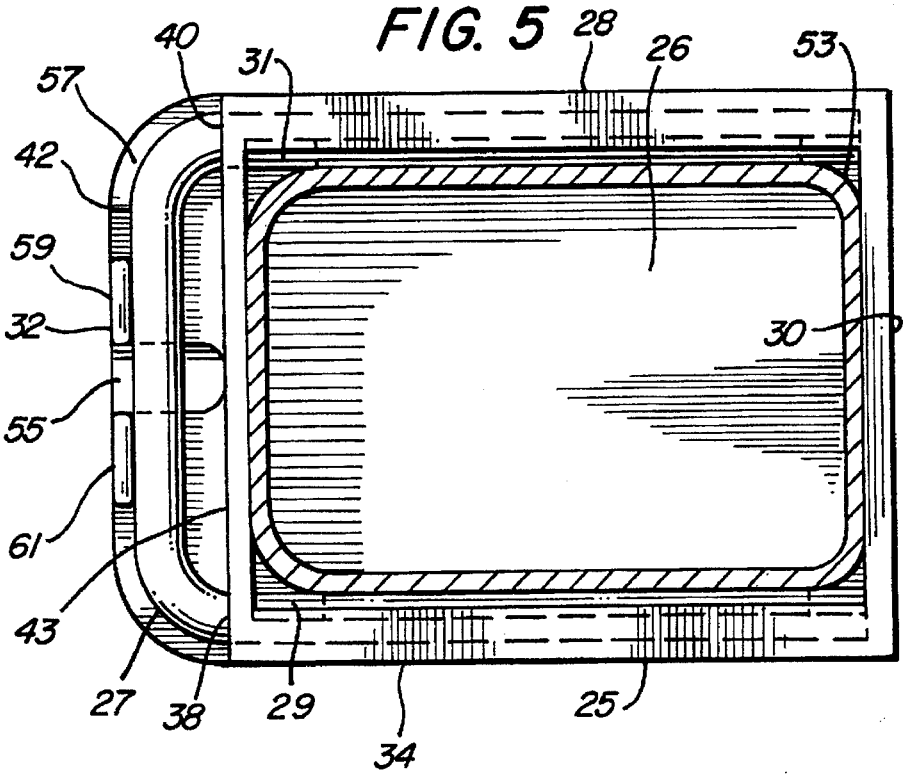
FIG. 5 is a top elevation of the base pad according to the present invention when not attached to the magazine tube.
Figure 6:
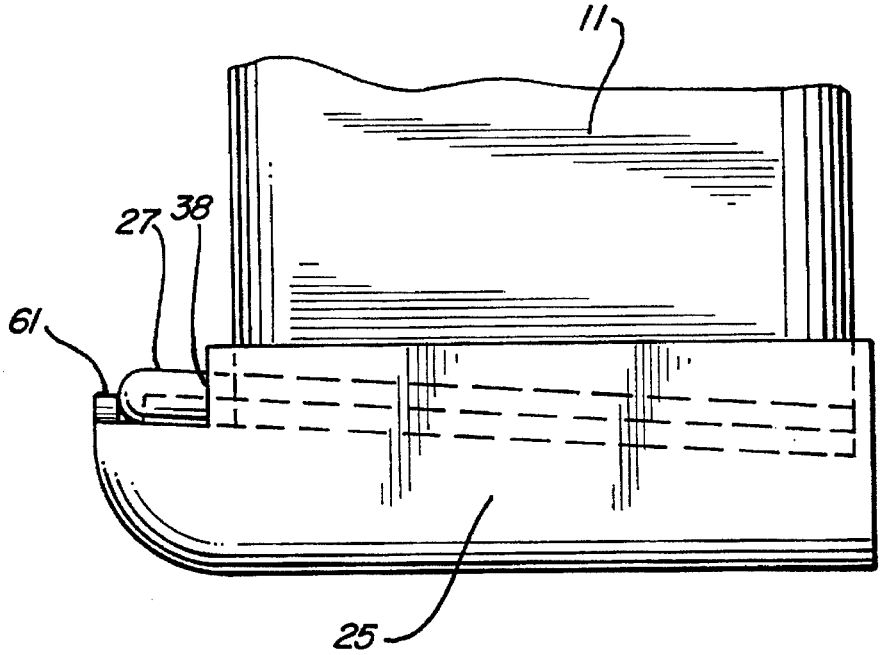
FIG. 6 is a side elevation of the base pad according to the present invention attached to the bottom of the magazine tube.

As can be more clearly seen in FIG. 5, the base of the magazine tube 11 will rest on a ledge 53 that circumscribes the cavity 26 in base pad 25 so that all four walls of magazine tube 11 are within the four walls 28, 30, 34, 43 of base pad 25. A two-legged clip 27 slides into a pair of channels 38, 40 so that the legs 29, 31 of the clip 27 overlay and hold fast the lips 24, 23 (FIG. 4) at the base of magazine tube 11. The legs 29, 31 of the clip (FIG. 7) are shown as round. In order for a close tolerance fit between legs 29, 31 of the clip 27 and the lips 23, 24 of the magazine tube 11, a right-angled wedge 33 has been cut out of leg 29, and a right-angled wedge 35 has been cut out of leg 31. It should be understood, of course, that the legs of clip 27 could just as well be rectangular or square, with the channels 38, 40 within the base pad conforming to that shape of the clip legs.

FIG. 5 shows clip 27 completely inserted into the base pad 25. In this position, the transverse connecting rod or head 42 of the clip 27 rests on a ledge 57 which has a pair of risers 61 and 59 located on either side of a depression 55 in ledge 57. During insertion, the head 42 of clip 27 is forced over risers 59 and 61 and is thereafter held tight and prevented from being easily withdrawn from its channels by these users. Clip 27 is preferably made of stainless steel and is capable of withstanding considerable abuse without deterioration in its strength or flexibility. Clip 27 is easily removed by inserting a screwdriver into depression 55 between the head 42 of the clip and the outside wall of base pad 25. Once the head of the clip 42 is moved past risers 61 and 59, it may be removed from its channels by hand.

Figure 8:
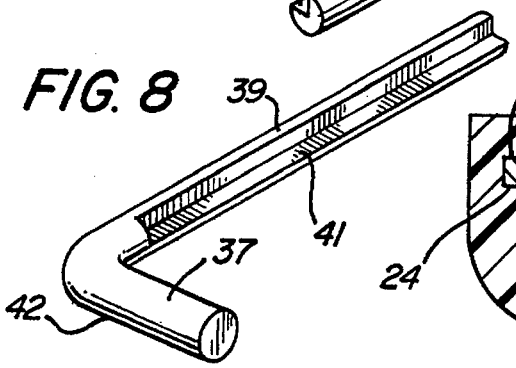
FIG. 8 is a perspective of an alternate preferred clip used to hold the base pad of the present invention to a magazine tube.
Figure 9:
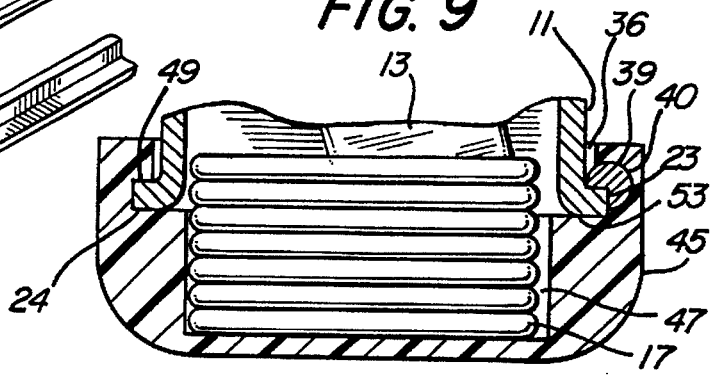
FIG. 9 is a cross-sectional view showing use of the single leg clip of FIG. 8 to fasten the base pad of the present invention to a magazine tube.

FIGS. 8 and 9 illustrate an alternate preferred embodiment for the base pad of the present invention. In this embodiment the magazine tube 11 is again inserted into the base pad by placing it into opening 36 until the bottom of magazine tube 11 with its lips 23, 24 rests on the ledge 53 on either side internal to the base pad 45. A cavity 47 extends considerably below ledge 53, providing additional room for the additional desired rounds.

In this particular embodiment, a clip with only one leg 39 is utilized to hold down the magazine 11. The other side of magazine 11 is held down by a slot 49 machined into the wall of base pad 45 to receive lip 24. Once the magazine tube 11 is inserted into the opening 36 in base pad 45, lip 24 is simply slid into slot 49. The single leg 39 of clip 37 is slid into its channel 40 located on the other side of base pad 45. The section 41 cut out of leg 39 leaves a flat surface that rides against lip 23. The clip of FIG. 8 is L-shaped, having a head 42 which is held fast to the base pad 45 in the same manner as the U-shaped clip 27 is held fast, by the risers 61, 59 located on opposite sides of depression 55.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. An improved base pad for attachment to the open bottom of a multiple round magazine tube, said magazine tube having a spring-loaded follower for feeding rounds to the top of the magazine, and a lip on two sides at its bottom, said base pad comprising:

a five-sided container having two opposite sides, two opposite ends, and a bottom, said container shaped to follow the contour and sized to fit over the bottom of said magazine tube;

a ledge inside said container, raised some distance from the bottom, said magazine tube resting on said ledge;

a pair of channels formed through one end of said container and along both sides above said ledge; and pins located in said channels holding the sides of said magazine tube to said ledge by overlaying the lip, on both sides at the bottom, of said magazine tube.

2. The improved base pad of claim 1 wherein said pins are attached by a perpendicular member, forming a single "U"-shaped clip with a cross-member and a pair of legs.

3. The improved base pad of claim 2 wherein said five-sided container has a recessed area and ledge at one end where said "U"-shaped clip is inserted into said channel; and a riser on the ledge holding said clip by its cross-member to the side of said container once said clip is fully inserted into the channels.

4. The improved base pad of claim 1 wherein said pins comprise a flat surface abutting the lips on the side of said magazine.

5. The improved base pad of claim 4 wherein said channels formed in said container are round in circumference.

6. The improved base pad of claim 5 wherein said pins have a circumference that is sized to fit within said round channels, and the flat surface in said pins is formed by cutting a wedge out of each pin.

7. The improved base pad of claim 5 wherein said pins are stainless steel.

8. The improved base pad of claim 1 wherein the ledge inside said container extends along the two opposite sides and the two opposite ends.

9. The improved base pad of claim 1 wherein said pins comprise a round cross-section.

10. An improved base pad for attachment to the open bottom of a multiple round magazine tube, said magazine tube including a spring-loaded follower for feeding rounds to the top of the magazine, and a lip on two of its sides at the open bottom, said base pad comprising:

a five-sided container having two opposite sides, two opposite ends, and a bottom, the interior of said container shaped to follow the contour of the bottom of said magazine tube, a ledge inside said container, raised some distance from the bottom of said container, the bottom of said magazine tube resting on said ledge;

a channel formed through one end of said container, along one side above said ledge; and a pin located in said channel holding said magazine to said ledge by overlaying the lip on the bottom of said magazine tube.

11. The improved base pad of claim 10 wherein said pin is "L"-shaped, with the long part being the leg and the short part being the head.

12. The improved base pad of claim 11 wherein said container has a recessed area and ledge at one end where said "L"-shaped pin is inserted into said channel; and a riser on the ledge holding said pin by its head to the side of the container once said pin is fully inserted into the channel.

13. The improved base pad of claim 12 wherein said pin has a flat surface on its leg that abuts the lip on the side of said magazine.

14. The improved base pad of claim 13 wherein said channel formed in said container is round in circumference.

15. The improved base pad of claim 14, wherein said pin has a circumference that is sized to fit within said round channel, and the flat surface in said pin is formed by a wedge-shaped cut in said pin.

16. The improved base pad of claim 15 wherein said pin is stainless steel.

17. The improved base pad of claim 10 wherein the ledge inside said container extends along said two opposite sides and two opposite ends.

18. The improved base pad of claim 17 further comprising a slot formed in the side of said container opposite the side having the channel, in alignment with the ledge, said slot sized to receive the lip on one side of said magazine tube.

19. The improved base pad of claim 10 wherein said pin comprises a round cross-section.

* * * * *